US009886822B2

(12) United States Patent
Penacho et al.

(10) Patent No.: US 9,886,822 B2
(45) Date of Patent: Feb. 6, 2018

(54) GAMING SYSTEM AND A METHOD OF GAMING

(71) Applicant: Aristocrat Technologies Australia Pty Limited, North Ryde (AU)

(72) Inventors: Gary Joseph Penacho, Henderson, NV (US); Tricia Tylman, Las Vegas, NV (US); Scott Monroe Stewart, Las Vegas, NV (US)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 143 days.

(21) Appl. No.: 13/933,778

(22) Filed: Jul. 2, 2013

(65) Prior Publication Data

US 2014/0011567 A1 Jan. 9, 2014

Related U.S. Application Data

(60) Provisional application No. 61/667,480, filed on Jul. 3, 2012.

(51) Int. Cl.
*G07F 17/34* (2006.01)
*A63F 9/00* (2006.01)

(52) U.S. Cl.
CPC ..... *G07F 17/34* (2013.01)

(58) Field of Classification Search
CPC ..... G07F 17/3211
See application file for complete search history.

(56) References Cited

U.S. PATENT DOCUMENTS

| | | | | |
|---|---|---|---|---|
| 7,927,207 | B2 | 4/2011 | Okada | |
| 2004/0116178 | A1 | 6/2004 | Okada | |
| 2008/0188283 | A1 | 8/2008 | Okada | |
| 2009/0131145 | A1* | 5/2009 | Aoki et al. | 463/20 |
| 2009/0197666 | A1* | 8/2009 | Visser | G07F 17/3265 463/20 |

(Continued)

FOREIGN PATENT DOCUMENTS

| | | |
|---|---|---|
| GB | 1 262 134 | 2/1972 |
| GB | 1 464 896 | 2/1977 |
| JP | 04220276 | 8/1992 |

(Continued)

*Primary Examiner* — Dmitry Suhol
*Assistant Examiner* — Ankit Doshi
(74) *Attorney, Agent, or Firm* — Amstrong Teasdale LLP

(57) ABSTRACT

A gaming system is provided, the gaming system including a plurality of reels, each reel having a plurality of display positions at which symbols can be positioned for display. The gaming system further includes a reel display controller arranged so as to reveal symbols that are positioned at display positions of at least one reel to a player, or to hide symbols that are positioned at the display positions of the at least one reel from the player. The gaming system is arranged to spin the reels in an initial spin, during which symbols positioned at the display positions of the at least one reel are revealed. The gaming system is then arranged to reposition the at least one reel after the initial spin and while symbols positioned at the display positions of the at least one reel are hidden and to reveal symbols displayed at the display positions of the at least one reel after the at least one reel has been repositioned.

32 Claims, 9 Drawing Sheets

(56) References Cited

U.S. PATENT DOCUMENTS

2012/0178521 A1 7/2012 Kim et al.

FOREIGN PATENT DOCUMENTS

| | | |
|---|---|---|
| JP | 08173591 | 7/1996 |
| JP | 2002263256 | 9/2002 |
| JP | 2004073651 | 3/2004 |
| JP | 2004073652 | 3/2004 |
| JP | 2004073653 | 3/2004 |
| JP | 2004073654 | 3/2004 |
| JP | 2004073655 | 3/2004 |
| JP | 2004073656 | 3/2004 |
| JP | 2004283548 | 10/2004 |
| JP | 2005007090 | 1/2005 |
| JP | 2005161096 | 6/2005 |
| JP | 2005224286 | 8/2005 |
| JP | 2005224455 | 8/2005 |
| JP | 2005245527 | 9/2005 |
| JP | 2005270137 | 10/2005 |
| JP | 2006034554 | 2/2006 |
| JP | 2006034555 | 2/2006 |
| JP | 2006034556 | 2/2006 |
| JP | 2006141559 | 6/2006 |
| JP | 2006280607 | 10/2006 |
| JP | 2007000396 | 1/2007 |
| JP | 2007111116 | 5/2007 |
| JP | 2007117421 | 5/2007 |
| JP | 2007-135861 A † | 6/2007 |
| JP | 2007215983 | 8/2007 |
| JP | 2008100087 | 5/2008 |
| JP | 2008183018 | 8/2008 |
| JP | 2008295964 | 12/2008 |
| JP | 2009005934 | 1/2009 |
| JP | 2009028258 | 2/2009 |
| JP | 2009055942 | 3/2009 |
| JP | 2009072436 | 4/2009 |
| JP | 2009082382 | 4/2009 |
| JP | 2009089984 | 4/2009 |
| JP | 2009131306 | 6/2009 |
| JP | 2009172167 | 8/2009 |
| JP | 2009240351 | 10/2009 |
| JP | 2009240819 | 10/2009 |
| JP | 2009285262 | 12/2009 |
| JP | 2009291442 | 12/2009 |
| JP | 2010104478 | 5/2010 |
| WO | 2011034301 | 3/2011 |

* cited by examiner
† cited by third party

GAMING SYSTEM AND A METHOD OF GAMING

CROSS-REFERENCE TO RELATED APPLICATIONS

The present application claims the benefit of priority to U.S. Provisional Patent Application No. 61/667,480, filed on Jul. 3, 2012, entitled "A GAMING SYSTEM AND A METHOD OF GAMING", which is herein incorporated by reference in its entirety.

FIELD

The present invention relates to a gaming system and to a method of gaming.

BACKGROUND

It is known to provide a gaming system arranged to randomly display several symbols from a predetermined set of symbols and to determine a game outcome such as a game win based on the displayed symbols.

There is a need to provide additional game variations and ways of displaying the reels so as to maintain and possibly increase player interaction.

BRIEF SUMMARY

In accordance with a first aspect, there is provided a gaming system including:

a plurality of reels, each reel having a plurality of display positions at which symbols can be positioned for display;

a reel display controller arranged so as to reveal symbols that are positioned at display positions of at least one reel to a player or to hide symbols that are positioned at the display positions of the at least one reel from the player;

wherein the gaming system is arranged to:

spin the reels in an initial spin, during which symbols positioned at the display positions of the at least one reel are revealed;

reposition the at least one reel after the initial spin and while symbols positioned at the display positions of the at least one reel are hidden; and reveal symbols displayed at the display positions of the at least one reel after the at least one reel has been repositioned.

The gaming system may be arranged to determine whether symbols positioned at the display positions after the initial spin correspond to a winning combination, and to award a prize to the player if a winning combination of symbols is determined.

The gaming system may be arranged to determine whether symbols positioned at the display positions after the at least one reel has been repositioned correspond to a winning combination, and to award a prize to the player if a winning combination of symbols is determined.

The gaming system may be arranged to reposition the at least one reel by re-spinning the at least one reel. The gaming system may be arranged to reposition the at least one reel such that a symbol positioned at at least one display position after repositioning is a wild symbol. The gaming system may be arranged to reposition the at least one reel such that each symbol positioned at each display position after repositioning is a wild symbol.

In one embodiment, the gaming system is arranged to determine a trigger condition and the gaming system is arranged to reveal symbols positioned at the display positions of the at least one reel in response to determination of the trigger condition. In one example the trigger condition is provided by an input, such as an input from a player. The input may be provided by touching a button of the gaming system. Further, or alternatively, the input may be provided by touching a display region of the gaming system that is associated with the at least one reel.

Further, or alternatively, the trigger condition may occur in response to a predetermined time or game event, such as a time at which the at least one reel comes to a rest after being repositioned.

In one embodiment, wherein the trigger condition is provided by an input, the gaming system is arranged to reveal symbols that are positioned at the display positions of the at least one reel at a time that the trigger condition is determined.

In one embodiment, the gaming system is arranged to allow a player to select the at least one reel from the plurality of reels. It will be appreciated that the selection may be made before, during or after the initial spin.

In one embodiment, the gaming system is arranged to operate in normal game mode and feature game mode, wherein the gaming system is arranged to:

spin the reels in an initial spin, during which symbols positioned at the display positions of the at least one reel are revealed when operating in normal game mode;

and to:

reposition the at least one reel after the initial spin and while symbols positioned at the display positions of the at least one reel are hidden; and reveal symbols displayed at the display positions of the at least one reel after the at least one reel has been repositioned when operating in feature game mode.

In one embodiment, the feature game mode is implemented in response to any one of:

a wager;

display of a particular symbol or symbol combination by the reels;

a random event;

a particular win combination associated with symbols displayed by the reels.

In one embodiment, the gaming system comprises at least one shutter that is arranged to move between a closed configuration so as to hide the symbols that are positioned at the display positions of the at least one reel and an open configuration so as to reveal symbols that are positioned at the display positions of the at least one reel. The gaming system may comprise a plurality of shutters, each shutter corresponding to a respective reel of the plurality of reels.

In one embodiment the reels are implemented as mechanical type reels.

In accordance with a second aspect, there is provided a method of gaming including:

spinning a plurality of reels, each reel having a plurality of display positions at which symbols can be positioned for display, during which at least one reel is arranged such that symbols that are positioned at the display positions of the at least one reel are revealed to a player;

repositioning the at least one reel after the initial spin while symbols positioned at the display positions of the at least one reel are hidden from the player; and revealing symbols displayed at the display positions of the at least one reel after the at least one reel has been repositioned.

The method may further include:

determining whether symbols positioned at the display positions after the initial spin correspond to a winning combination; and awarding a prize to the player if a winning combination of symbols is determined.

In one embodiment, the method further includes:

determining whether symbols positioned at the display positions after the at least one reel has been repositioned correspond to a winning combination; and awarding a prize to the player if a winning combination of symbols is determined.

In one embodiment, repositioning the at least one reel may include re-spinning the at least one reel.

In one embodiment, a symbol positioned at at least one display position of the at least one reel after repositioning the at least one reel is a wild symbol. Each symbol positioned at each display position of the at least one reel after repositioning the at least one reel may be a wild symbol.

The method may further include:

determining a trigger condition; and revealing symbols positioned at the display positions of the at least one reel in response to determination of the trigger condition.

In one embodiment, the trigger condition is provided by an input. The input may be provided by touching a button of the gaming system. Further, or alternatively, the input may be provided by touching a display region of the gaming system that is associated with the at least one reel.

The trigger condition may occur in response to a predetermined time or game event.

For embodiments wherein the trigger condition is provided by an input, the method may include revealing symbols that are positioned at the display positions of the at least one reel at a time that the trigger condition is determined.

The method may include selecting the at least one reel from the plurality of reels.

In one embodiment, the method includes:

operating a gaming system in normal game mode, normal game mode operation comprising:

spinning the reels in an initial spin, during which symbols positioned at the display positions of the at least one reel are revealed when operating in normal game mode; and operating the gaming system in feature game mode, feature game mode operation comprising:

repositioning the at least one reel after the initial spin and while symbols positioned at the display positions of the at least one reel are hidden; and revealing symbols displayed at the display positions of the at least one reel after the at least one reel has been repositioned.

The feature game mode may be implemented in response to any one of:

a wager;

display of a particular symbol or symbol combination by the reels;

a random event;

a particular win combination associated with symbols displayed by the reels.

The method may include:

moving a shutter to a closed configuration so as to hide the symbols that are positioned at the display positions of the at least one reel; and moving the shutter to an open configuration so as to reveal symbols that are positioned at the display positions of the at least one reel.

In accordance with a third aspect, there is provided a computer program arranged when loaded into a computing device to instruct the computing device to operate in accordance with the gaming system of the first aspect.

In accordance with a fourth aspect, there is provided a computer readable medium having a computer readable program code embodied therein for causing a computing device to operate in accordance with the gaming system of the first aspect.

In accordance with a fifth aspect, there is provided a data signal having a computer readable program code embodied therein to cause a computing device to operate in accordance with the gaming system of the first aspect.

BRIEF DESCRIPTION OF DRAWINGS

Features and advantages of the present invention will become apparent from the following description of certain embodiments thereof, by way of example only, with reference to the accompanying drawings, in which.

Figure 1:
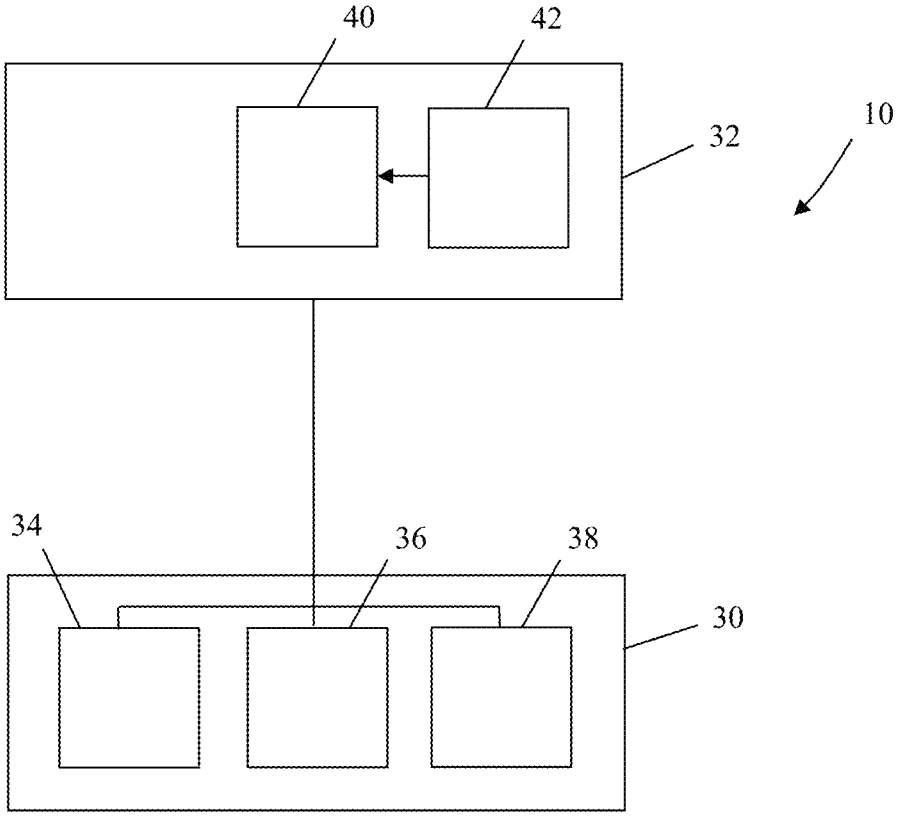
FIG. 1 is a schematic block diagram of components of a gaming system in accordance with an embodiment.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION

Although the following discloses example methods, systems, articles of manufacture, and apparatus including, among other components, software executed on hardware, it should be noted that such methods and apparatus are merely illustrative and should not be considered as limiting. For example, it is contemplated that any or all of these hardware and software components could be embodied exclusively in hardware, exclusively in software, exclusively in firmware, or in any combination of hardware, software, and/or firmware. Accordingly, while the following describes example methods, systems, articles of manufacture, and apparatus, the examples provided are not the only way to implement such methods, systems, articles of manufacture, and apparatus.

When any of the appended claims are read to cover a purely software and/or firmware implementation, at least one of the elements in an at least one example is hereby expressly defined to include a tangible medium such as a memory, DVD, CD, Blu-ray, etc., storing the software and/or firmware.

Embodiments of the present invention relate to a gaming system and to a method of gaming. In general, the present gaming system operates such that, during game play, a plurality of symbols are randomly selected from a set of symbols and displayed at a corresponding plurality of display position groups, each of which includes a plurality of display positions. The symbols shown at the display positions are used to determine game outcomes by comparing the displayed symbols with defined winning combinations.

In one conventional type of gaming machine, a display area including 15 display positions is presented to a player with each display position including one symbol. The display positions are arranged in five vertically disposed reels, with each reel having three visible display positions. After the reels are spun and subsequently stopped, the display positions show a random selection of symbols.

Generally, with such games, a plurality of win patterns in the form of win lines are defined which extend across the reels and include one display position from each reel. Typically the symbols that form a win line are compared with winning symbol combinations defined in a pay table so as to determine whether a player of the game should receive an award. For example, if winning symbol combinations are based on poker hands, a particular prize would be awarded if the win line includes four aces. Other winning symbol combinations and corresponding prizes may also be defined by a pay table.

In an embodiment, the gaming system is arranged to selectively hide symbols that are positioned at display positions of at least one reel from a player, or to reveal the symbols that are positioned at the display positions of the at least one reel to the player.

When the player instructs the gaming system to play a game, the gaming system is arranged to spin the reels in an initial spin, during which symbols positioned at display positions of all reels are revealed to the player. After this initial spin, a determination may be made as to whether or not the player should receive an award.

After the initial spin, the player is able to select one or more reels. The gaming system is arranged to hide symbols that are positioned at the display positions of the selected reel(s) and to reposition the selected reel(s) while symbols positioned at the display positions of the selected reel(s) are hidden from the player's view. Repositioning the selected reel(s) may include repositioning the selected reel(s) to predetermined positions, such as positions wherein wild symbols are positioned at the display positions, or repositioning the selected reel(s) to random positions.

In one example, the selected reel(s) are repositioned by re-spinning the selected reel(s).

After the selected reel(s) have been repositioned, the gaming system is arranged to reveal symbols that are positioned at the display positions of the selected reel(s) to the player.

A gaming system that utilizes the general concept of hiding symbols that are positioned at display positions of selected reel(s) after an initial spin, repositioning the selected reel(s) while the symbols thereof are hidden from view and thereafter revealing symbols that are positioned at the display positions of the selected reel(s) will now be described in more detail.

The description that follows generally describes a gaming system that is arranged to display virtual reels, however it will be appreciated that a similar idea may be applied to a gaming system that employs mechanical reels.

Referring to the drawings, there is shown a schematic block diagram of a gaming system 10 arranged to implement a probabilistic game of the type wherein several symbols from a set of symbols are randomly displayed, and a game outcome is determined on the basis of the displayed symbols. The system is of the type including multiple game modes such as being operable in normal game mode wherein a base game is implemented and special game mode wherein a feature game is implemented.

With some such probabilistic games, the set of symbols used during normal game mode include standard symbols and function symbols, and the game outcome is determined on the basis of the displayed standard symbols and the function associated with any displayed function symbol. For example, standard symbols may resemble fruit such as apples, pears and bananas with a win outcome being determined when a predetermined number of the same fruit appear on a display along a win line, or are displayed according to defined outcome patterns such as scattered, and so on. The function associated with a function symbol may be for example a wild function wherein display of the function symbol is treated during consideration of the game outcome as any of the standard symbols. A function symbol may be represented as the word "WILD", a star, or by any other suitable word or symbol. Other functions are also envisaged such as scatter functions, multiplier functions, repeat win functions, jackpot functions and feature commencement functions.

Referring to FIG. 1, a schematic diagram of components of a gaming system 10 in accordance with an embodiment is shown. The components include a player interface 30 and a game controller 32. The player interface 30 is arranged to enable interaction between a player and the gaming system and for this purpose includes input/output components required for the player to enter instructions and play the game.

Components of the player interface 30 may vary but will typically include a credit mechanism 34 to enable a player to input credits and receive payouts, one or more displays 36 which may include a touch screen, and a game play mechanism 38 arranged to enable a player to input game play instructions.

The game play mechanism 38 is arranged to allow a player to instruct the gaming system 10 to initiate spinning of reels in an initial spin. The game play mechanism 38 is also arranged to allow the player to select at least one reel to be hidden by the gaming system 10 after the initial spin. In response to the selection the gaming system 10 is arranged to hide symbols that are positioned at the display positions of the at least one reel and to reposition the selected reel, such as by re-spinning the selected reel, while the selected reel is hidden from the player.

The game play mechanism 38 is also arranged to allow the player to instruct the gaming system 10 to reveal the selected reel after the selected reel has been repositioned, although it will be appreciated that the gaming system 10 may be arranged to automatically reveal the selected reel, for example immediately after the selected reel has been repositioned. The player instructions may be input by pressing appropriate buttons such as buttons 62 shown in FIG. 3, or by interacting with a display 54 that includes a touch screen usable by the player to interact with the gaming system 10.

The game controller 32 is in data communication with the player interface 30 and typically includes a processor 40 arranged to process game play instructions and output game player outcomes to the display 36. Typically, the game play instructions are stored as program code in a memory 42 that can also be hardwired. It will be understood that in this specification the term "processor" is used to refer generically to any device that can process game play instructions and may include a microprocessor, microcontroller, programmable logic device or other computational device such as a personal computer or a server.

Figure 2:
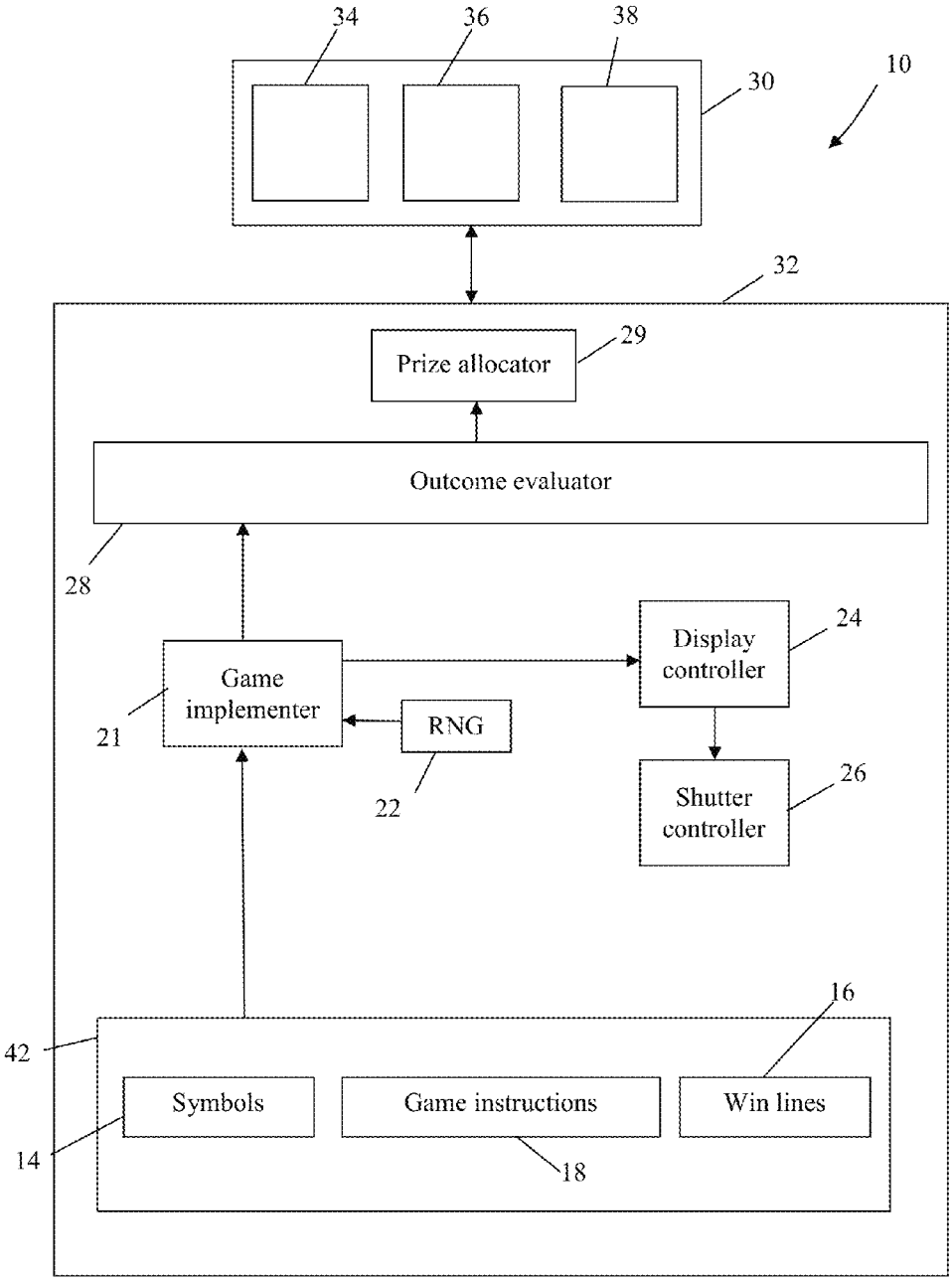
FIG. 2 is a schematic block diagram of functional components of a gaming system in accordance with an embodiment.

A functional diagram illustrating operative components of the game controller 32 is shown in FIG. 2.

The memory 42 is arranged to store symbols data 14 indicative of a plurality of symbols, in the present example associated with a plurality of reels, win lines data 16 indicative of available win lines, and game instruction data 18 indicative of game instructions usable by the gaming machine 10 to control operation of the game.

The game controller 32 includes a game implementer 21 which is arranged to select several symbols from the available symbols 14 for display to a player in a plurality of display positions of the reels. In this example, the selection carried out by the game implementer 21 is made using a random number generator 22.

It will be appreciated that the random number generator 22 may be of a type which is arranged to generate pseudo random numbers based on a seed number, and that in this specification the term "random" will be understood accordingly to mean truly random or pseudo random.

The game controller 32 further includes a display controller 24 arranged to control display of the reels at the one or more displays 36. In this embodiment, the game controller 32 also includes a shutter controller 26 arranged to hide and reveal the selected at least one reel by covering the selected at least one reel from view by means of a virtual or a mechanical shutter.

The game controller 32 also includes an outcome evaluator 28 which, in accordance with game instructions 18 determines game outcomes based on the symbols selected by the game implementer 21 for display to the player by the display controller 24.

The game controller 32 also includes a prize allocator 29 arranged to allocate a prize to a player when a winning outcome exists.

In the embodiment described below, the game implementer 21, the random number generator 22, the display controller 24, the shutter controller 26, the outcome evaluator 28, and the prize allocator 29 are at least partly implemented using the processor 40 and associated software although it will be understood that other implementations are envisaged.

The gaming system 10 can take a number of different forms.

In a first form, a player operable gaming device in the form of a stand alone gaming machine is provided wherein all or most components to implement the game are present in the gaming machine.

In a second form, a distributed architecture is provided wherein some of the components to implement the game are present in a player operable gaming device and some of the components to implement the game are located remotely relative to the gaming device. For example, a "thick client" architecture may be used wherein part of the game is executed on a player operable gaming terminal and part of the game is executed remotely, such as by a gaming server; or a "thin client" architecture may be used wherein most of the game is executed remotely such as by a gaming server and a player operable gaming terminal is used only to display audible and/or visible gaming information to the player and receive gaming inputs from the player.

However, it will be understood that other arrangements are envisaged. For example, an architecture may be provided wherein a gaming device is networked to a device server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 3:
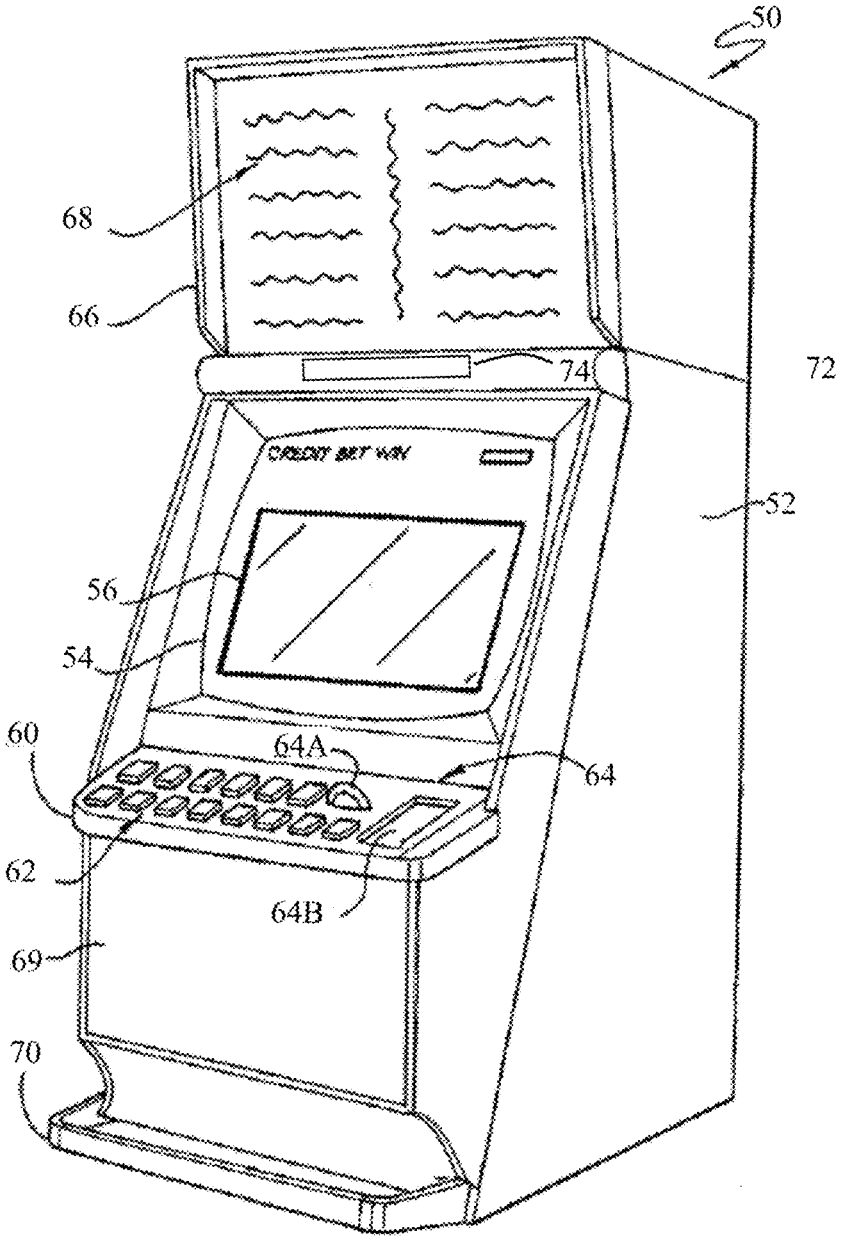
FIG. 3 is a diagrammatic representation of a gaming system in accordance with an embodiment of the present invention with the gaming system implemented in the form of a stand alone gaming machine.

A gaming system in the form of a stand alone gaming machine 50 is illustrated in FIG. 3. The gaming machine 50 includes a console 52 having a display 54 on which is displayed representations of a game 56 that can be played by a player. A mid-trim 60 of the gaming machine 50 houses a bank of buttons 62 for enabling a player to interact with the gaming machine, in particular during gameplay. The mid-trim 60 also houses a credit input mechanism 64 which in this example includes a coin input chute 64A and a bill collector 64B. Other credit input mechanisms may also be employed, for example, a card reader for reading a smart card, debit card or credit card.

A top box 66 may carry artwork 68, including for example pay tables and details of bonus awards and other information or images relating to the game. Further artwork and/or information may be provided on a front panel 69 of the console 52. A coin tray 70 is mounted beneath the front panel 69 for dispensing cash payouts from the gaming machine 50.

The display 54 is in the form of a video display unit, particularly a cathode ray tube screen device. Alternatively, the display 54 may be a liquid crystal display, plasma screen, or any other suitable video display unit. The top box 66 may also include a display, for example a video display unit, which may be of the same type as the display 54, or of a different type. The display 54 may include a touch screen usable by a player to interact with the gaming machine, in particular during game play.

The display 54 in this example is arranged to display representations of several reels, each reel of which has several associated symbols. Typically 3, 4 or 5 reels are provided. During operation of the game, the reels first appear to rotate then stop with typically three symbols visible on each reel. Game outcomes are determined on the basis of the visible symbols together with any special functions associated with the symbols.

A player marketing module (PMM) 72 having a display 74 is connected to the gaming machine 50. The main purpose of the PMM 72 is to allow the player to interact with a player loyalty system. The PMM has a magnetic card reader for the purpose of reading a player tracking device, for example as part of a loyalty program. However other reading devices may be employed and the player tracking device may be in the form of a card, flash drive or any other portable storage medium capable of being read by the reading device. In this example, the PMM 62 is a Sentinel III device produced by Aristocrat Technologies Pty Ltd.

Figure 4:
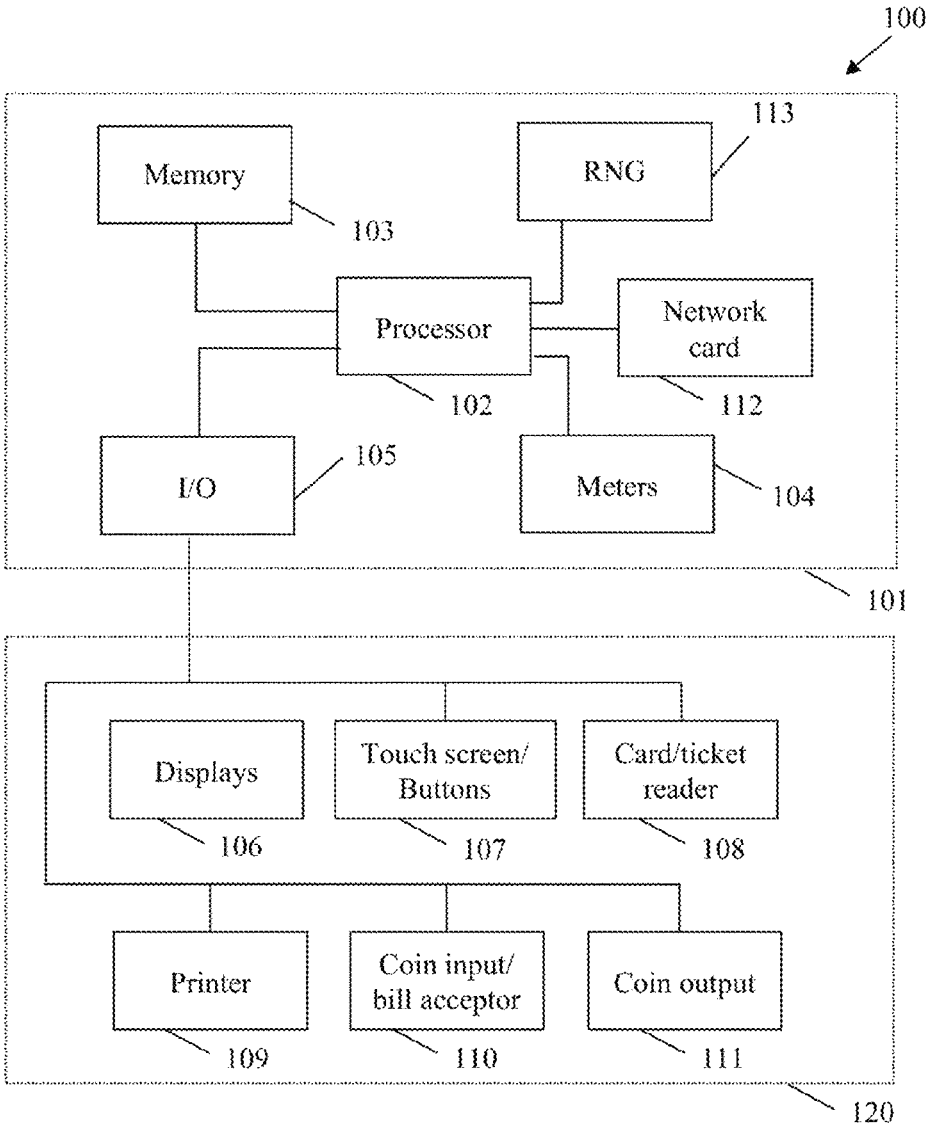
FIG. 4 is a schematic block diagram of operative components of the gaming machine shown in FIG. 3.

FIG. 4 shows a block diagram of operative components of a gaming device 100 which may be the same as or different to the gaming machine shown in FIG. 3.

The gaming machine 100 includes a game controller 101 having a processor 102. Instructions and data to control operation of the processor 102 in accordance with the present invention are stored in a memory 103 which is in data communication with the processor 102.

Typically, the gaming machine 100 will include both volatile and non-volatile memory and more than one of each type of memory, with such memories being collectively represented by the memory 103.

Figure 5:
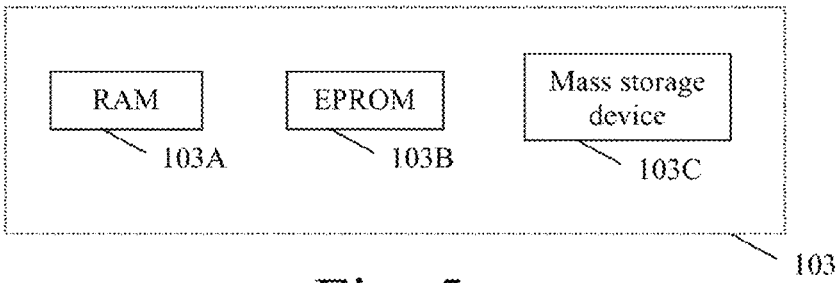
FIG. 5 is a schematic block diagram of components of a memory of the gaming machine shown in FIG. 3.

FIG. 5 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

The gaming machine has hardware meters 104 for purposes including ensuring regulatory compliance and monitoring player credit, an input/output (I/O) interface 105 for communicating with a player interface 120 of the gaming machine 100, the player interface 120 having several peripheral devices. The input/output interface 105 and/or the peripheral devices may be intelligent devices with their own memory for storing associated instructions and data for use with the input/output interface or the peripheral devices. A random number generator module 113 generates random numbers for use by the processor 102.

In the example shown in FIG. 4, the peripheral devices that communicate with the game controller 101 include one or more displays 106, a touch screen and/or bank of buttons 107, a card and/or ticket reader 108, a printer 109, a bill acceptor and/or coin input mechanism 110 and a coin output mechanism 111. Additional hardware may be included as part of the gaming machine 100, or hardware may be omitted based on the specific implementation.

In addition, the gaming machine 100 may include a communications interface, for example a network card 112. The network card may, for example, send status information, accounting information or other information to a central controller, server or database and receive data or commands from the central controller, server or database.

It is also possible for the operative components of the gaming machine 100 to be distributed, for example input/output devices 106, 107, 108, 109, 110, 111 may be provided remotely from the game controller 101.

Figure 6:
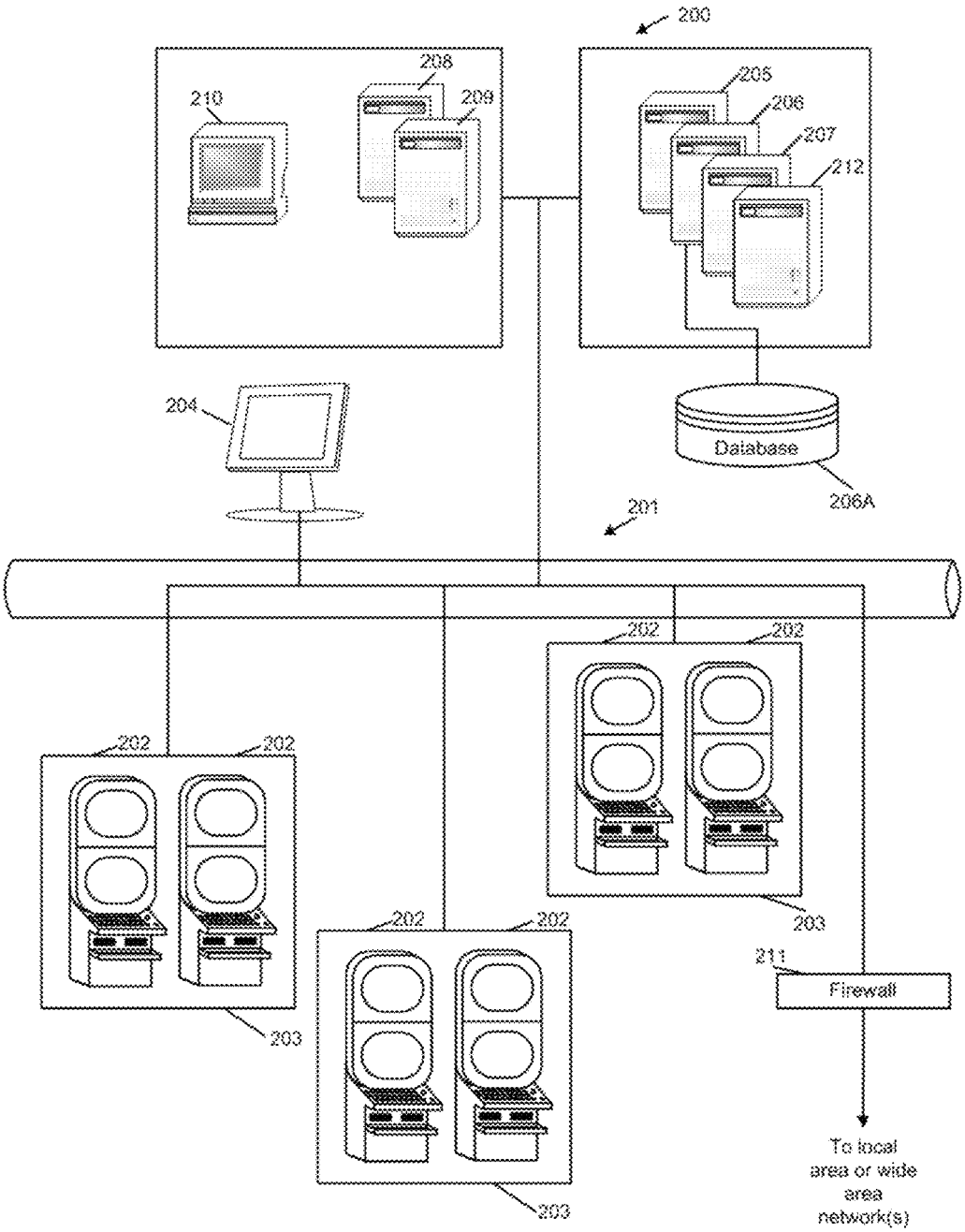
FIG. 6 is a schematic diagram of a gaming system in accordance with an alternative embodiment wherein the gaming system is implemented over a network.

FIG. 6 shows a gaming system 200 in accordance with an alternative embodiment. The gaming system 200 includes a network 201, which for example may be an Ethernet network, a LAN or a WAN. In this example, three banks 203 of two gaming machines 202 are connected to the network 201. The gaming machines 202 provide a player operable interface and may be the same as the gaming machines 40,100 shown in FIGS. 3 and 4, or may have simplified functionality depending on the rules, guidelines, requirements, and/or preferences to implement game play. While banks 203 of two gaming machines are illustrated in FIG. 6, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, a game server 205 implements part of the game played by a player using a gaming machine 202 and the gaming machine 202 implements part of the game. With this embodiment, as both the game server 205 and the gaming machine 202 implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game.

In a variation of the above thick client embodiment, the gaming machine 202 may implement the game, with the game server 205 functioning merely to serve data indicative of a game to the gaming machine 202 for implementation.

With this implementation, a data signal containing a computer program usable by the client terminal to implement the gaming system may be transferred from the game server to the client terminal, for example in response to a request by the client terminal.

In a thin client embodiment, the game server 205 implements most or all of the game played by a player using a gaming machine 202 and the gaming machine 202 essentially provides only the player interface. With this embodiment, the game server 205 provides the game controller. The gaming machine will receive player instructions, and pass the instructions to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming system 200, including for example a gaming floor management server 208 and a licensing server 209 to monitor the use of licenses relating to particular games. An administrator terminal 210 is provided to allow an administrator to monitor the network 201 and the devices connected to the network.

The gaming system 200 may communicate with other gaming systems, other local networks such as a corporate network, and/or a wide area network such as the Internet, for example through a firewall 211.

A loyalty program server 212 may also be provided.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random number generator engine. Alternatively, a separate random number generator server could be provided.

Examples of specific implementations of the gaming system will now be described in relation to a stand alone gaming machine 50 although it will be understood that implementation may also be carried out using other gaming system architectures such as a network architecture of the type shown in FIG. 6.

In this example, the gaming system includes five reels, each reel corresponding to a display position group, each of which has an associated set of display positions for displaying symbols.

The reels are arranged to display standard symbols and one or more function symbols and win outcomes are determined on the basis of the symbols visible at the display positions when the reels stop rotating.

Typically, a player will purchase or otherwise obtain win entitlements such as several win lines which are used in the game to determine win outcomes. If the displayed symbols on the reels have symbols associated with a winning combination such as a winning combination disposed on a win line, the player wins a prize.

The gaming system is operable in normal game mode and special game mode and may be arranged to commence special game mode when a predetermined game outcome occurs. Special game mode may include one or more free games. Special game mode may commence automatically on the basis of a game event occurring during a game such as display of a particular symbol, based on game outcomes determined by the gaming system, or may be prompted by a player pressing a button on the gaming system 10 after the player has identified that a game outcome corresponding to special game mode requirements has occurred.

The gaming system 10 may also be arranged so as to determine eligibility for special game mode, for example based on the amount or type of bet placed, based on certain time periods and so on.

Special game mode may also be arranged to commence when a special game is purchased by a player.

A specific example will now be described in relation to flow diagram 250 shown in FIG. 7 which illustrates blocks 252 to 255 of a method of gaming implemented by the gaming system 10 according to an embodiment.

Figure 7:
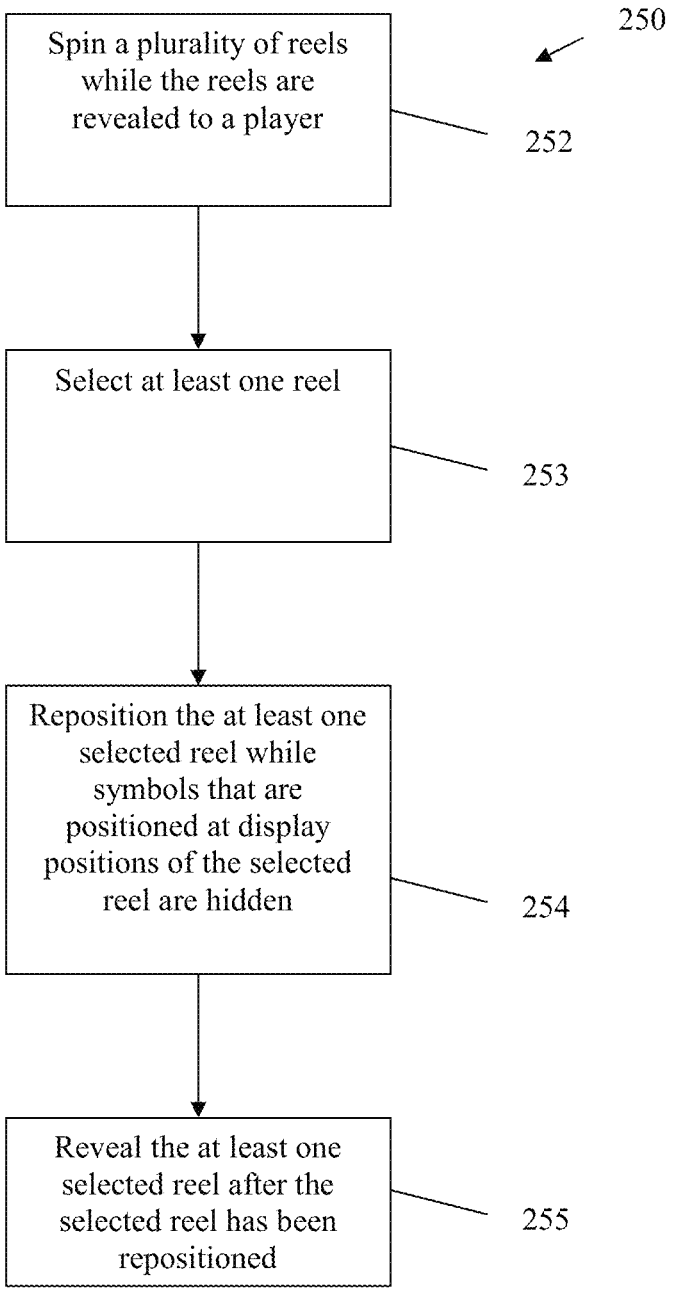
FIG. 7 is a flow diagram illustrating a method of gaming in accordance with an embodiment.

FIG. 7 illustrates a flowchart of an example method. FIG. 7 depicts an example flow diagram representative of process(es) that may be implemented using, for example, computer readable instructions that may be used to facilitate game play and/or gaming tax management. The example process(es) of FIG. 7 may be performed using a processor, a controller and/or any other suitable processing device. For example, the example process(es) of FIG. 7 may be implemented using coded instructions (e.g., computer readable instructions) stored on a tangible computer readable medium such as a flash memory, a read-only memory (ROM), and/or a random-access memory (RAM). As used herein, the term tangible computer readable medium is expressly defined to include any type of computer readable storage and to exclude propagating signals. Additionally or alternatively, the example processes of FIGS. 6 and 7 may be implemented using coded instructions (e.g., computer readable instructions) stored on a non-transitory computer readable medium such as a flash memory, a read-only memory (ROM), a random-access memory (RAM), a cache, or any other storage media in which information is stored for any duration (e.g., for extended time periods, permanently, brief instances, for temporarily buffering, and/or for caching of the information). As used herein, the term non-transitory computer readable medium is expressly defined to include any type of computer readable medium and to exclude propagating signals.

Alternatively, some or all of the example process(es) of FIG. 7 may be implemented using any combination(s) of application specific integrated circuit(s) (ASIC(s)), programmable logic device(s) (PLD(s)), field programmable logic device(s) (FPLD(s)), discrete logic, hardware, firmware, etc. Also, some or all of the example process(es) of FIG. 7 may be implemented manually or as any combination(s) of any of the foregoing techniques, for example, any combination of firmware, software, discrete logic and/or hardware. Further, although the example process(es) of FIG. 7 are described with reference to the flow diagram, other methods of implementing the process(es) of FIG. 7 may be employed. For example, the order of execution of the blocks may be changed, and/or some of the blocks described may be changed, eliminated, sub-divided, or combined. Additionally, any or all of the example process(es) of FIG. 7 may be performed sequentially and/or in parallel by, for example, separate processing threads, processors, devices, discrete logic, circuits, etc.

It will be appreciated that at least part of the method and gaming system of embodiments of the present may be implemented digitally by a processor. Persons skilled in the art will also appreciate that embodiments may be implemented utilising program code. The program code could be supplied in a number of ways, for example on a tangible computer readable storage medium, such as a disc or a memory (for example, that could replace part of memory 103) or as a data signal (for example, by transmitting it from a server). Persons skilled in the art, will appreciate that program code provides a series of instructions executable by a processor.

In the example of FIG. 7, five spinnable reels 280, 282, 284, 286, 288 are provided and displayed on a graphical display device 54 in a display area 290, as shown in FIGS. 8*a* to 8*d*. Each reel 280, 282, 284, 286, 288 includes three display positions 292 for displaying corresponding symbols 294. It will be understood that any number of reels/display position groups may be provided.

Each reel 280, 282, 284, 286, 288 is associated with a respective shutter, each shutter being movable between a closed configuration and an open configuration. For example, shutter 298 is associated with reel 286 and is shown in the closed configuration in FIG. 8*b*. When the shutters are in the open configuration, the shutters are not visible to a player, and the display positions 292 are not hidden from the player.

The configuration of each shutter is controlled by the shutter controller 26, the shutter controller 26 being arranged to facilitate hiding the display positions 292 of each shutter's respective reel 280, 282, 284, 286, 288 by controlling each shutter to move to the closed configuration, and to facilitate revealing the display positions 292 of each shutter's respective reel 280, 282, 284, 286, 288 by controlling each shutter to move to the open configuration.

During implementation of a game, at block 252, the reels 280, 282, 284, 286, 288 are spun in an initial spin. During the initial spin, the shutter controller 26 controls the shutters such that the shutters are in the open configuration and the display positions 292 of each reel 280, 282, 284, 286, 288 are revealed to the player.

Figure 8A:
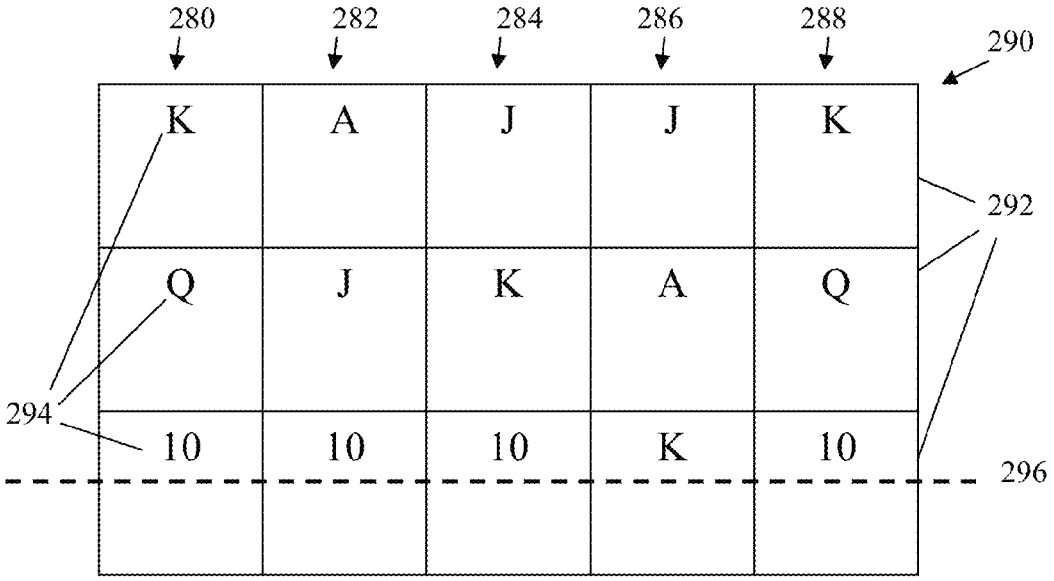
FIGS. 8*a* to 8*d* are diagrammatic representations of reel representations displayed by a gaming system in accordance with an embodiment.
Figure 8B:
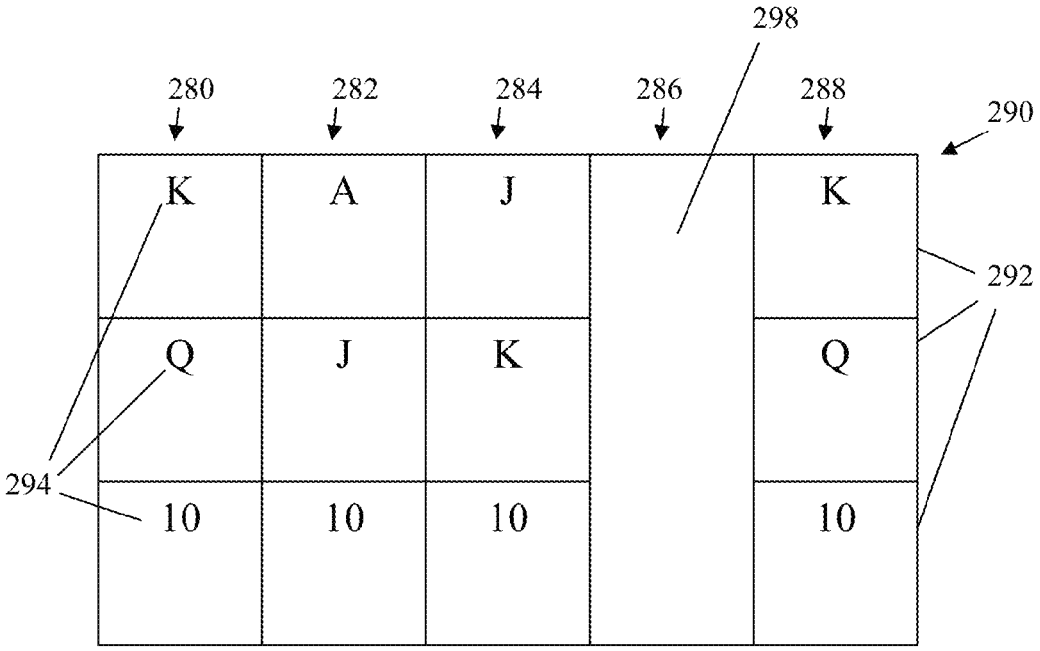

The reels 280, 282, 284, 286, 288 will eventually come to a rest to display an array of symbols 294 to the player. An example of a possible outcome from block 252 is shown in FIG. 8*a*. In this example, the player achieved four non-continuous '10' symbols along win line 296. The player is able to see that, if he had also achieved a '10' symbol in the bottom display position 292 of reel 286, the player would have achieved five continuous '10' symbols and been allocated an appropriate prize.

At block 253, the player selects at least one reel that is to be repositioned while the at least one reel is hidden from the player. In this example, the player selects reel 286, recognizing that achieving an appropriate symbol, such as a '10' or a 'WILD' symbol, in the lowermost display position 292 will result in the allocation of a prize. The selection is made, in this example, by touching a region of the display 54 corresponding to the reel 286. Any other form of facilitating such a selection is envisaged, for example by player interaction with the buttons 62.

In response to selection 253 of the reel 286, the shutter controller 26 of the gaming system 10 instructs the shutter 298 to move to the closed configuration so as to hide the display positions 292, and any symbols 294 positioned at the display positions 292, of the reel 286 from the player's view.

Figure 8C:
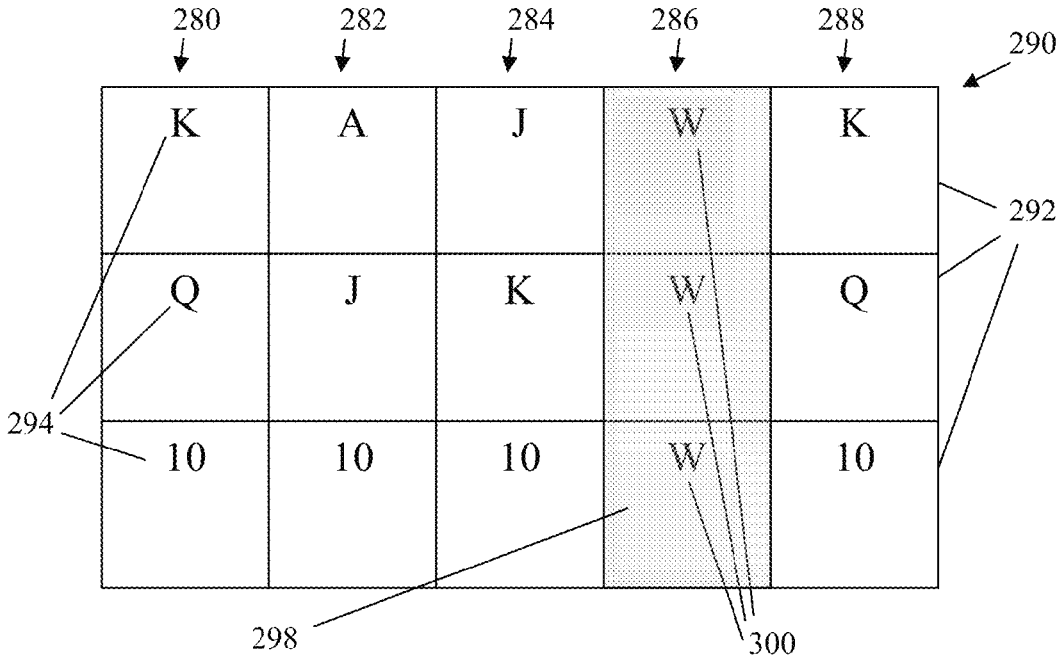
Figure 8D:
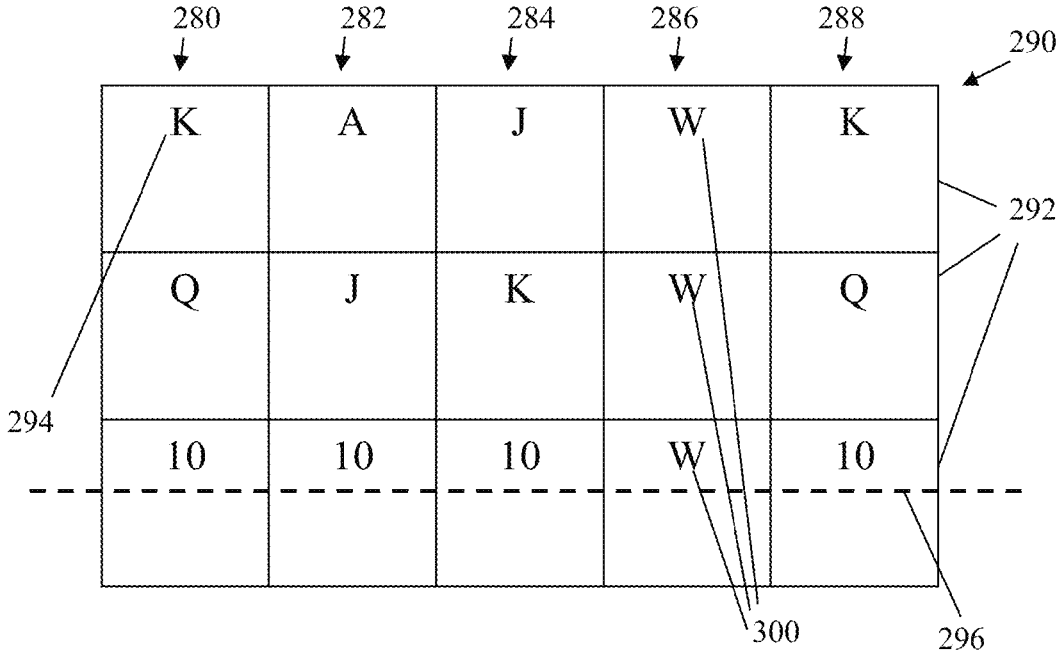

At block 254, the gaming system 10 repositions the selected reel 286 while the shutter 298 is closed and the reel 286 is hidden from view. In this example, the selected reel 286 is repositioned 254 such that 'WILD' symbols 300 are positioned at the display positions 292 of the selected reel 286, as shown in FIG. 8*c*. At this stage, it will be appreciated that the 'WILD' symbols 300 are still hidden from the player's view, the cross-hatching of the shutter 298 indicating that the 'WILD' symbols 300 are behind the shutter 298.

At block 255, the shutter controller 26 instructs the shutter 298 to move to the open configuration, thereby revealing the 'WILD' symbols 300 to the player. The shutter controller 26 can instruct the shutter 298 to move to the open configuration in response to the player selecting the reel 286 and/or shutter 298, for example by touching a region of the display 54 corresponding to the reel 286 and/or shutter 298. Further, or alternatively, the shutter controller 26 can be arranged to instruct the shutter 298 to move to the open configuration automatically, such as at a time after the 'WILD' symbols 300 are in position behind the shutter 298, or after a predefined time period.

As a result of block 255, the display positions 292 are revealed to the player, including the 'WILD' symbols 300. The gaming system 10 then determines if there are any winning symbol combinations and allocates a prize to the player if a winning symbol combination is determined. In this example, the 'WILD' symbol 300 displayed at the lowermost display position 292 of the reel 286 completes a winning symbol combination of five '10' symbols along the win line 296. This winning symbol combination is determined and the player is awarded the corresponding prize.

In the above example, the selected reel 286 was described as being repositioned such that 'WILD' symbols 300 are positioned at the display positions 292 of the selected reel 286. This may be achieved by re-spinning the reel 286 to a position showing only 'WILD' symbols at the display positions 292, although it will be appreciated that any way of repositioning the reel 286 is envisaged.

It will be appreciated that the gaming system 10 may not necessarily reposition the selected reel 286 such that 'WILD' symbols 300 are positioned at the display positions 292 of the selected reel 286. The gaming system 10 may be arranged to reposition the selected reel 286 such that any random symbols are positioned at the display positions 292 such as by re-spinning the reel 286 to a random position. Further, or alternatively, the gaming system 10 may be arranged to reposition the reel 286 so that a particular bonus symbol is displayed at at least one of the display positions 292 of the reel 286.

As described earlier, the gaming system is arranged to operate in normal game mode and feature game mode. In one embodiment, the feature game mode corresponds to the steps 252 to 255 of the method 250, although it will be appreciated that the feature game may include steps 253 to 255 of the method 250, wherein the first step 252 of spinning the reels in an initial spin is part of normal game mode and a particular symbol combination achieved during the initial spin 252 triggers the feature game mode.

It will also be appreciated that more than one reel 280, 282, 284, 286, 288 may be selected by the player to be hidden, wherein each selected reel is repositioned while hidden from the player after the initial spin, and subsequently revealed to the player after each selected real has been repositioned. That is, the steps 252 to 255 may apply to a plurality of reels.

Modifications and variations as would be apparent to a skilled addressee are determined to be within the scope of the present invention.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art is referred to herein, such reference does not constitute an admission that the prior art forms a part of the common general knowledge of the art in any country.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings. It will be understood that the invention disclosed and defined in this specification extends to all alternative combinations of two or more of the individual features mentioned or evident from the text or drawings. All of these different combinations constitute various alternative aspects of the invention.

The present invention contemplates methods, systems and program products on any electronic device and/or machine-readable media suitable for accomplishing its operations. Certain embodiments of the present invention may be implemented using an existing computer processor and/or by a special purpose computer processor incorporated for this or another purpose or by a hardwired system, for example.

Embodiments within the scope of the present invention include program products comprising machine-readable media for carrying or having machine-executable instructions or data structures stored thereon. Such machine-readable media can be any available media that can be accessed by a general purpose or special purpose computer or other machine with a processor. By way of example, such machine-readable media may comprise RAM, ROM, PROM, EPROM, EEPROM, Flash, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

Figure 9:
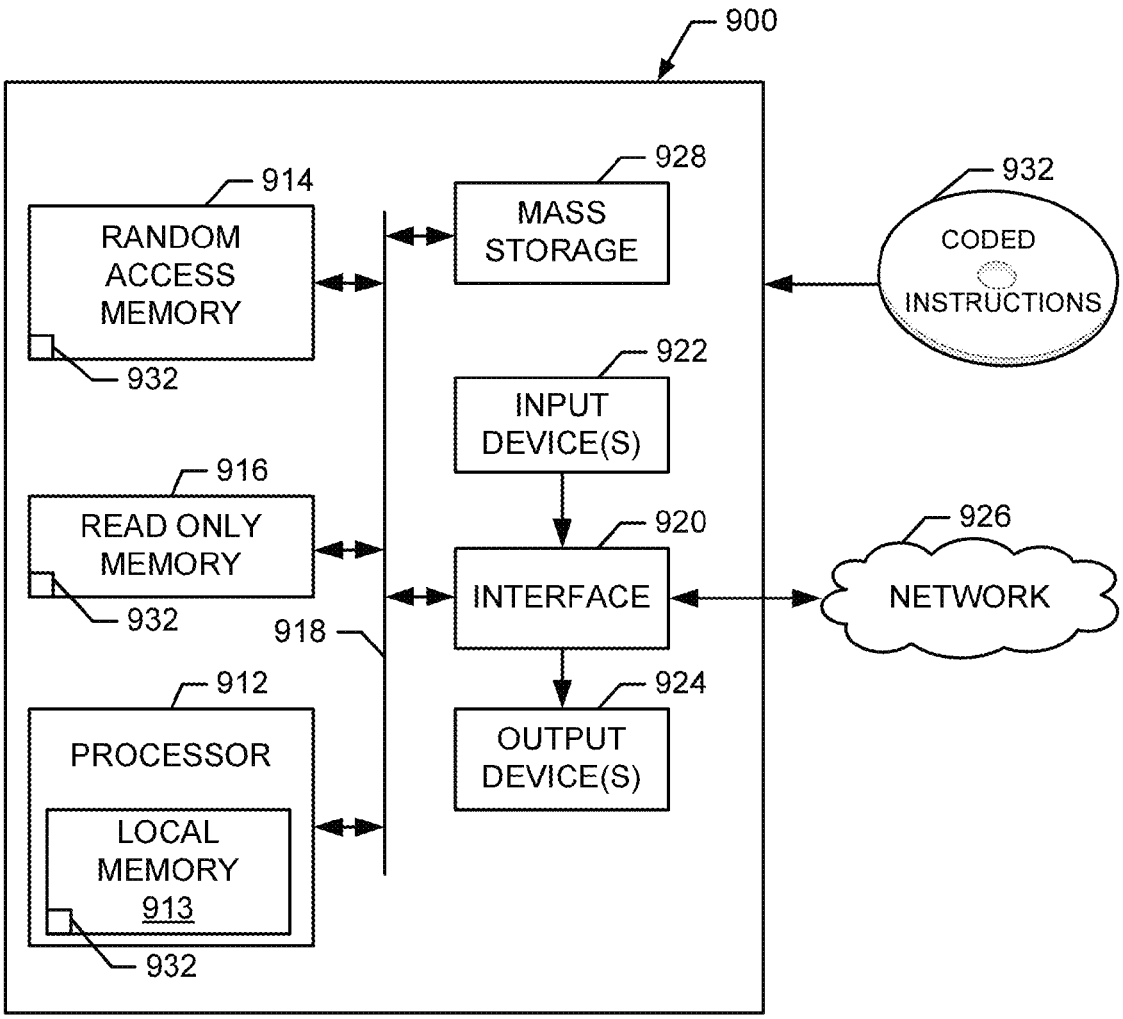
FIG. 9 is a block diagram of an example processor platform that may be used to execute computer-readable instructions to implement example systems and methods described and disclosed herein.

For example, FIG. 9 is a block diagram of an example processor platform 900 capable of executing the instructions of FIG. 7 to implement the example systems and methods disclosed and described herein. The processor platform 900 can be, for example, a server, a personal computer, an Internet appliance, a set top box, or any other type of computing device.

The processor platform 900 of the instant example includes a processor 912. For example, the processor 912 can be implemented by one or more microprocessors or controllers from any desired family or manufacturer. The processor 912 includes a local memory 913 (e.g., a cache) and is in communication with a main memory including a volatile memory 914 and a non-volatile memory 916 via a bus 918. The volatile memory 914 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 916 may be implemented by flash memory and/or any other desired type of memory device. Access to the main memory 914, 916 is controlled by a memory controller.

The processor platform 900 also includes an interface circuit 920. The interface circuit 920 may be implemented by any type of interface standard, such as an Ethernet interface, a universal serial bus (USB), and/or a PCI express interface.

One or more input devices 922 are connected to the interface circuit 920. The input device(s) 922 permit a user to enter data and commands into the processor 912. The input device(s) can be implemented by, for example, a keyboard, a mouse, a touchscreen, a track-pad, a trackball, isopoint and/or a voice recognition system.

One or more output devices 924 are also connected to the interface circuit 920. The output devices 924 can be implemented, for example, by display devices (e.g., a liquid crystal display, a cathode ray tube display (CRT), etc.). The interface circuit 920, thus, typically includes a graphics driver card.

The interface circuit 920 also includes a communication device such as a modem or network interface card to facilitate exchange of data with external computers via a network 926 (e.g., an Ethernet connection, a digital subscriber line (DSL), a telephone line, coaxial cable, a cellular telephone system, etc.).

The processor platform 900 also includes one or more mass storage devices 928 for storing software and data. Examples of such mass storage devices 928 include floppy disk drives, hard drive disks, compact disk drives and digital versatile disk (DVD) drives. The mass storage device 928 may implement a local storage device.

The coded instructions 932 of FIG. 7 may be stored in the mass storage device 928, in the volatile memory 914, in the non-volatile memory 916, and/or on a removable storage medium such as a CD or DVD.

The invention claimed is:

1. A gaming system comprising:

a credit mechanism by which a monetary value can be added to a gaming machine, the credit mechanism configured to receive credit input by a player for contribution to a credit balance associated with the player;

a player interface configured to receive a wager input by the player to initiate a gaming session;

an award output mechanism configured to increase the credit balance by an award amount corresponding to a winning combination for the gaming session;

a plurality of reels, each reel having a plurality of display positions at which symbols can be positioned for display;

a shutter arranged to move between a closed configuration, to hide symbols that are positioned at display positions of at least one reel, and an open configuration, to reveal symbols that are positioned at the display positions of the at least one reel;

a shutter controller operable to move the shutter to the open configuration or the closed configuration;

wherein the gaming system is arranged to:

spin the plurality of reels in an initial spin, during which the shutter is in the open configuration such that each of the display positions of the plurality of reels are revealed;

receive a player selection of at least one of the plurality of reels to be closed and respun in response to determining that a winning combination has not occurred as a result of the initial spin;

move the shutter to the closed configuration over the at least one selected reel such that all of the symbols positioned at display positions of the at least one selected reel are hidden from the player;

reposition the display positions of the at least one selected reel after the initial spin and while the shutter is in the closed configuration; and move the shutter to the open configuration to reveal symbols displayed at the display positions of the at least one selected reel after the display positions of the at least one selected reel have been repositioned.

2. The gaming system of claim 1, wherein the gaming system is arranged to determine whether symbols positioned at the display positions after the initial spin correspond to a winning combination, and to award a prize to the player if a winning combination of symbols is determined.

3. The gaming system of claim 1, wherein the gaming system is arranged to determine whether symbols positioned at the display positions after the at least one reel has been repositioned correspond to a winning combination, and to award a prize to the player if a winning combination of symbols is determined.

4. The gaming system of claim 1, wherein the gaming system is arranged to reposition the at least one reel by re-spinning the at least one reel.

5. The gaming system of claim 1, wherein the gaming system is arranged to reposition the at least one reel such that a symbol positioned at a display position after repositioning is a wild symbol.

6. The gaming system of claim 5, wherein the gaming system is arranged to reposition the at least one reel such that each symbol positioned at each display position after repositioning is a wild symbol.

7. The gaming system of claim 1, wherein the gaming system is arranged to determine a trigger condition and to reveal symbols positioned at the display positions of the at least one reel in response to determination of the trigger condition.

8. The gaming system of claim 7, wherein the trigger condition is provided by an input.

9. The gaming system of claim 8, wherein the input is provided by touching a button of the gaming system.

10. The gaming system of claim 8, wherein the input is provided by touching a display region of the gaming system that is associated with the at least one reel.

11. The gaming system of claim 7, wherein the trigger condition occurs in response to a predetermined time or game event.

12. The gaming system of claim 7, wherein the trigger condition is provided by an input and the gaming system is arranged to reveal symbols that are positioned at the display positions of the at least one reel at a time that the trigger condition is determined.

13. The gaming system of claim 1, wherein the gaming system is arranged to allow a player to select the at least one reel from the plurality of reels.

14. The gaming system of claim 1, wherein the gaming system is arranged to operate in normal game mode and feature game mode, and wherein the gaming system is further arranged to:

spin the plurality of reels in an initial spin, during which symbols positioned at the display positions of the plurality of reels are revealed when operating in normal game mode;

and to:

reposition the at least one reel after the initial spin and while symbols positioned at the display positions of the at least one reel are hidden; and reveal symbols displayed at the display positions of the at least one reel after the at least one reel has been repositioned when operating in feature game mode.

15. The gaming system of claim 14, wherein the feature game mode is implemented in response to any one of:

a wager;

display of a particular symbol or symbol combination by the plurality of reels;

a random event; and a particular win combination associated with symbols displayed by the plurality of reels.

16. The gaming system of claim 1, wherein the gaming system comprises a plurality of shutters, each shutter corresponding to a respective reel of the plurality of reels.

17. The gaming system of claim 1, wherein the plurality of reels are implemented as mechanical type reels.

18. A method of gaming comprising:

receiving, by a credit mechanism by which a monetary value can be added to a gaming machine, credit input by a player for contribution to a credit balance associated with the player, the credit mechanism including at least one of a bill acceptor, a coin input, a card reader, and a ticket reader;

receiving, by a player interface, a wager input by the player to initiate a gaming session;

spinning a plurality of reels in an initial spin, each reel having a plurality of display positions at which symbols can be positioned for display, during the initial spin, the plurality of reels is arranged in an open configuration such that symbols that are positioned at the display positions of the plurality of reels are revealed to a player;

receiving a player selection of at least one reel of the plurality of reels to be closed and respun in response to determining that a winning combination has not occurred as a result of the initial spin;

moving, by a shutter controller, a shutter to a closed configuration to hide the symbols positioned at the display positions of the at least one selected reel;

repositioning the display positions of the at least one selected reel after the initial spin while the shutter is in the closed configuration and the symbols positioned at the display positions of the at least one selected reel are hidden from the player;

moving, by the shutter controller, the shutter to an open configuration to reveal symbols positioned at the display positions of the at least one selected reel; and increasing the credit balance by an award amount corresponding to a winning combination.

19. The method of claim 18, further comprising:

determining whether symbols positioned at the display positions after the initial spin correspond to a winning combination; and awarding a prize to the player if a winning combination of symbols is determined.

20. The method of claim 18, further comprising:

determining whether symbols positioned at the display positions after the at least one reel has been repositioned correspond to a winning combination; and awarding a prize to the player if a winning combination of symbols is determined.

21. The method of claim 18, wherein repositioning the at least one reel comprises re-spinning the at least one reel.

22. The method of claim 18, wherein a symbol positioned at a display position of the at least one reel after repositioning the at least one reel is a wild symbol.

23. The method of claim 22, wherein each symbol positioned at each display position of the at least one reel after repositioning the at least one reel is a wild symbol.

24. The method of claim 18, further comprising:

determining a trigger condition; and revealing symbols positioned at the display positions of the at least one reel in response to determination of the trigger condition.

25. The method of claim 24, wherein the trigger condition is provided by an input.

26. The method of claim 25, wherein the input is provided by touching a button of the gaming system.

27. The method of claim 25, wherein the input is provided by touching a display region of the gaming system that is associated with the at least one reel.

28. The method of claim 24, wherein the trigger condition occurs in response to a predetermined time or game event.

29. The method of claim 24, wherein the trigger condition is provided by an input and the method comprises the step of revealing symbols that are positioned at the display positions of the at least one reel at a time that the trigger condition is determined.

30. The method of claim 18, further comprising receiving a player selection of the at least one reel from the plurality of reels.

31. The method of claim 18, further comprising:

operating a gaming system in normal game mode, normal game mode operation comprising spinning the reels in an initial spin, during which symbols positioned at the display positions of the at least one reel are revealed when operating in normal game mode; and operating the gaming system in feature game mode, feature game mode operation comprising:

repositioning the at least one reel after the initial spin and while symbols positioned at the display positions of the at least one reel are hidden; and revealing symbols displayed at the display positions of the at least one reel after the at least one reel has been repositioned.

32. The method of claim 31, wherein the feature game mode is implemented in response to any one of:

a wager;

display of a particular symbol or symbol combination by the plurality of reels;

a random event; and a particular win combination associated with symbols displayed by the plurality of reels.

* * * * *